US007905986B2

(12) United States Patent
Hladik et al.

(10) Patent No.: US 7,905,986 B2
(45) Date of Patent: Mar. 15, 2011

(54) PAPER WITH PHOTO-FEEL BACKCOAT

(75) Inventors: Molly L. Hladik, San Diego, CA (US); Richard J. McManus, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/042,806

(22) Filed: Mar. 5, 2008

(65) Prior Publication Data

US 2008/0152878 A1 Jun. 26, 2008

Related U.S. Application Data

(62) Division of application No. 11/062,482, filed on Feb. 23, 2005.

(60) Provisional application No. 60/622,935, filed on Oct. 29, 2004.

(51) Int. Cl.

| | |
|---|---|
| ***D21H 17/25*** | (2006.01) |
| ***D21H 17/28*** | (2006.01) |
| ***D21H 17/33*** | (2006.01) |
| ***D21H 17/35*** | (2006.01) |
| ***D21H 17/36*** | (2006.01) |
| ***D21H 21/54*** | (2006.01) |

(52) U.S. Cl. ..... 162/135; 162/164.1; 162/168.1; 162/173; 162/184; 427/201; 428/32.22; 428/402

(58) Field of Classification Search ..... 162/135, 162/164, 168.1, 173, 184; 427/201; 428/32.22, 428/402

See application file for complete search history.

(56) References Cited

U.S. PATENT DOCUMENTS

| | | | | |
|---|---|---|---|---|
| 3,664,912 | A | 5/1972 | Olson | |
| 3,791,856 | A | 2/1974 | Duling et al. | |
| 4,554,566 | A | 11/1985 | Yoneda et al. | |
| 4,898,849 | A | 2/1990 | Kang | |
| 4,958,173 | A * | 9/1990 | Fitch et al. | 346/135.1 |
| 5,049,595 | A | 9/1991 | Dethlefs et al. | |
| 5,104,914 | A * | 4/1992 | Elton et al. | 524/22 |
| 5,135,835 | A * | 8/1992 | Aono et al. | 430/203 |
| 5,141,914 | A | 8/1992 | Kang | |
| 5,310,591 | A * | 5/1994 | Dodge et al. | 428/195.1 |
| 5,445,866 | A * | 8/1995 | Martinson et al. | 428/32.14 |
| 5,501,902 | A | 3/1996 | Kronzer | |
| 5,919,590 | A * | 7/1999 | Yu et al. | 358/1.15 |
| 6,274,301 | B1 * | 8/2001 | Okamura et al. | 430/619 |
| 6,284,034 | B1 | 9/2001 | Hiorns | |

(Continued)

FOREIGN PATENT DOCUMENTS

EP 1 331 103 A 7/2003

(Continued)

OTHER PUBLICATIONS

JP OA dated Feb. 9, 2010.

*Primary Examiner* — Matthew J Daniels
*Assistant Examiner* — Dennis Cordray

(57) ABSTRACT

A method of treating paper to have a photo-feel backcoating includes preparing a mixture of a binder and polyethylene particles wherein the polyethylene particles have first and second sizes, and coating the mixture onto a surface of a sheet of paper which is opposite the surface of the sheet which is configured to receive printing thereon.

18 Claims, 3 Drawing Sheets

U.S. PATENT DOCUMENTS

| | | | | |
|---|---|---|---|---|
| 6,326,415 | B1 | 12/2001 | Miklasiewicz et al. | |
| 6,420,016 | B1 | 7/2002 | Peternell et al. | |
| 6,471,811 | B1 | 10/2002 | DeBoer | |
| 6,638,585 | B2 * | 10/2003 | Niu et al. | 428/32.22 |
| 6,753,051 | B1 * | 6/2004 | Landry-Coltrain et al. | 428/32.36 |
| 2003/0040558 | A1 | 2/2003 | Kerr et al. | |
| 2003/0152721 | A1 * | 8/2003 | Barcock et al. | 428/32.35 |
| 2003/0198885 | A1 * | 10/2003 | Tamagawa et al. | 430/124 |
| 2004/0010071 | A1 * | 1/2004 | Gebhart et al. | 524/523 |
| 2004/0067345 | A1 * | 4/2004 | Hladik et al. | 428/195.1 |
| 2004/0166252 | A1 * | 8/2004 | Takashima et al. | 428/32.1 |
| 2006/0229405 | A1 * | 10/2006 | Westerman et al. | 524/501 |

FOREIGN PATENT DOCUMENTS

| | | | |
|---|---|---|---|
| JP | 62 245258 | A * | 10/1987 |
| JP | 11-131389 | | 5/1995 |
| JP | 1997-123623 | | 5/1997 |
| JP | 10-228076 | A * | 8/1998 |
| JP | 1999-301106 | | 2/1999 |
| JP | 2002-264481 | | 9/2002 |

* cited by examiner

PAPER WITH PHOTO-FEEL BACKCOAT

CROSS-REFERENCE TO RELATED APPLICATIONS

This application is a divisional of co-pending U.S. patent application Ser. No. 11/062,482, filed on Feb. 23, 2005, which claims benefit of U.S. Provisional Application No. 60/622,935, filed Oct. 29, 2004, both of which are incorporated by reference herein in their entirety.

BACKGROUND

The present disclosure relates to a paper which is provided with a coating on a surface opposite to that which receives printing thereon and which provides a photobase feel to the paper.

Paper which exhibits a photobase feeling is inherently expensive due to the procedures/materials required to produce the same. For example, the process of extruding polyethylene onto paper sheet requires specialized equipment which is not widely available and normally not available in the mills in which the paper is initially produced. Thus, the cost of such paper is increased not only because of the need for specialized extrusion equipment but because of the need to move the paper from the point of manufacture to another site for the coating operation.

A simpler, less expensive technique for producing such paper is therefore necessary.

BRIEF DESCRIPTION OF THE DRAWINGS

The various aspects and features of this disclosure will become more clearly appreciated as a detailed description of the preferred embodiments is given with reference to the appended drawings wherein.

DETAILED DESCRIPTION

Figure 1:
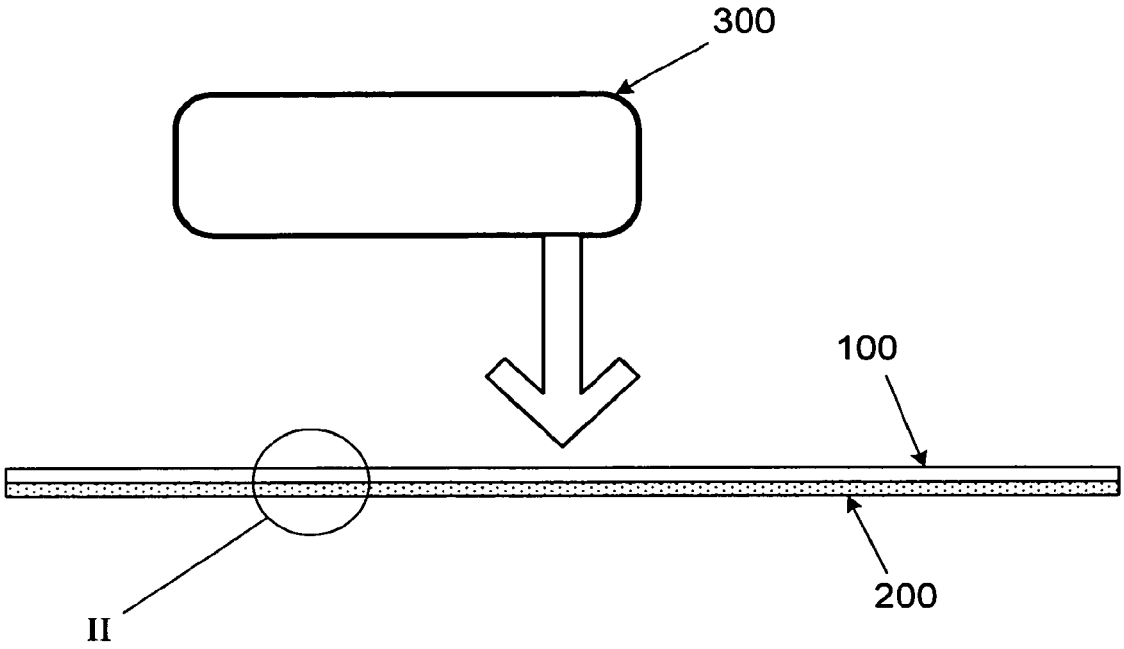
FIG. 1 is a schematic side view of an embodiment of the disclosure.

In an embodiment of the disclosure, a sheet of paper or basestock 100, which can be either untreated or treated, is coated with a "photo feel" layer 200 comprising one or more binders and polyethylene particles. This photo feel coating 200 is provided on a surface 102 of the paper which is opposite the printing surface 101 on which printing is carried out.

Figure 2:
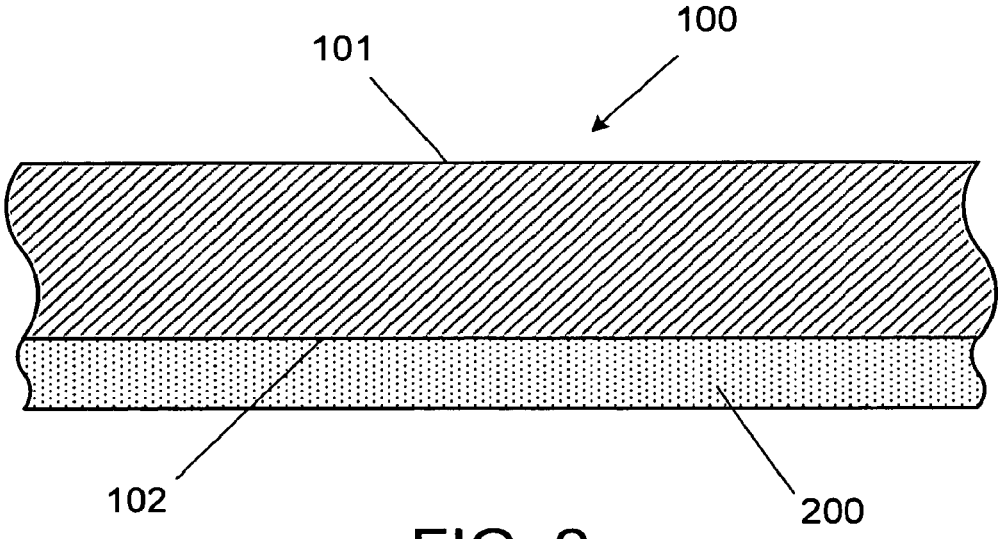
FIG. 2 is an enlarged view of the portion of the coated sheet enclosed in circle 11 of FIG. 1 wherein the sheet comprises untreated basestock.
Figure 3:
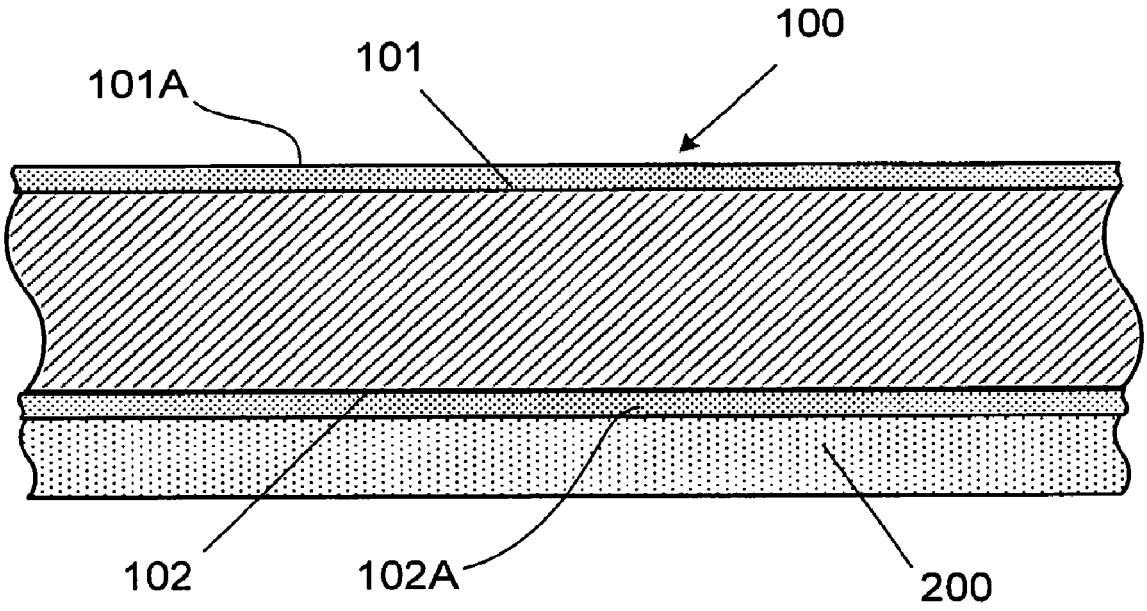
FIG. 3 is an enlarged view of the portion of the coated sheet enclosed in circle 11 of FIG. 1 wherein the sheet comprises treated basestock.
Figure 4:
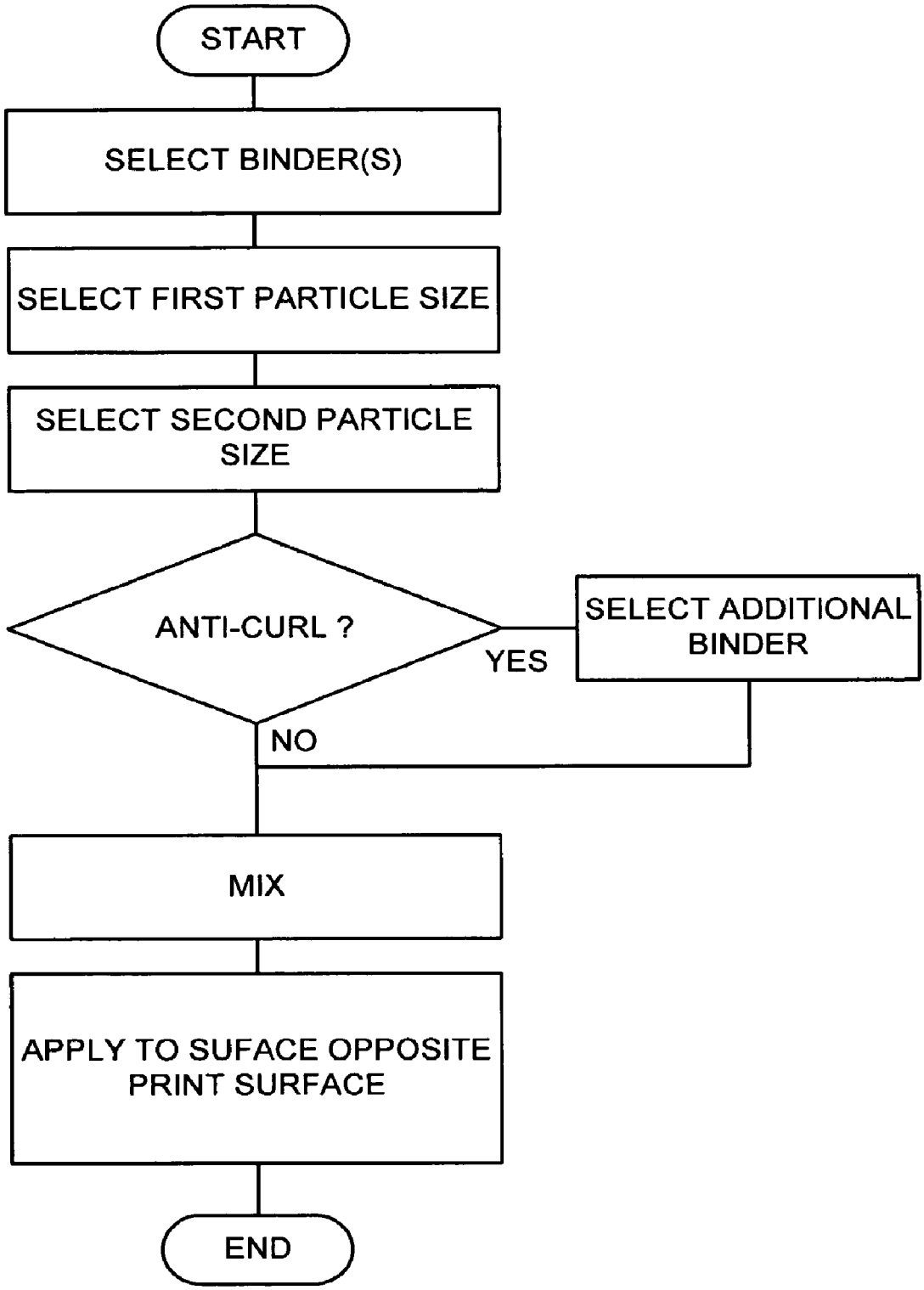
FIG. 4 is a flow chart depicting the steps which are carried out in accordance with one embodiment of the disclosure.

In the case of untreated basestock, the photo feel coating 200 is applied directly to the basestock in the manner shown in FIG. 2. In the case of treated basestock, wherein both sides are treated via the application of a print enhancing offset coating comprised of, but not limited to clays, grounded calcium carbonate, precipitated calcium carbonate, barium sulfate, titanium dioxide, silica, aluminum trihydrate, aluminum oxide, boehmite, and combinations thereof, the photo feel coating 200 is applied to the print enhancing offset coating 102A in the manner shown in FIG. 3.

The coating technique via which the photo feel coating is applied can, with the exception of extrusion, be selected from any suitable commercially available technique such as curtain coating, rod coating or slot coating. However, embodiments of the disclosure are not limited to these arrangements and gravure coating, reverse roll coating, knife over roll coating, for example, are not excluded.

The thickness of the coating can be varied between about 3 and about 50 gsm (grams per square meter). Usually coatings of about 5-25 gsm would be adequate, however this thickness can be varied depending upon the application and the paper that is used.

The paper or basestock to which the coating can be applied can be selected from commercially available stock such as "Galerie one gloss" and "Galerie one silk" produced by M-real of Kangus Finland, and # Savvy and # Influence by International Paper. The embodiments of the disclosure are, of course not limited to these selections and can be applied to different substrates (paper) as appropriate.

In FIG. 1 a printing arrangement 300 is schematically depicted printing onto the printing surface 101. This printing arrangement may take the form of an inkjet printer, but is not limited thereto. For example, the printing arrangement can take the form of electrographic print, gravure, etc.

In one embodiment of the disclosure, the paper 100 can have the printing surface 101 coated with a layer or layers of material which facilitate ink jet printing. However, the embodiments of the disclosure are not limited to this type of treatment and can include treatment with calcium carbonate or silica, clay, aluminum oxide, aluminum trihydrates, titanium dioxide, aluminum silicates, etc. or the like.

The coating or layer 200 can comprise a single binder such as latex acrylic in which polyethylene particles are dispersed. In accordance with one embodiment of the disclosure, these polyethylene particles have at least two different sizes. A first group of particles can have a diameter in the range of about 25-200 nanometers while a second group can have a diameter in the range of about 1-6 microns. In accordance with one embodiment, a more preferred particle sizes range for the first particles is about 30-70 nm and a more preferred particle size for the second particle is about 3-5 microns.

The above mentioned binder can be selected from but not limited to styrene, styrene-acrylic, styrene-butadiene, acrylic, polyvinyl acetate, etc. It is also within the scope of the present disclosure to use a mixture of the just mentioned binders.

In a further embodiment of the disclosure an anti-curl agent can be introduced into the coating. This anti-curl agent can be a binder which can be selected from, but is not limited to polyvinyl alcohol, gelatin, starches, cellulose, modified cellulose, etc.

The combination of the large and small particles contributes to The smooth photo feel of the backcoat which provides the photobase characteristics. The use of similar sized particles does not provide the desired feel, and, while it has not been positively determined, it is suspected that the smaller particles tend to fill in the gaps between the larger particles and provide a smoothing effect which leads to the desired feel of the backcoat.

To further illustrate embodiment(s) of the present disclosure, various examples are given herein. It is to be understood that these examples are provided for illustrative purposes and are not to be construed as limiting the scope of the disclosed embodiment(s).

In an embodiment, a method of treating paper to have a photo-feel backcoating is provided which comprises: preparing a mixture of a binder and polyethylene particles wherein the polyethylene particles have first and second sizes; and coating the mixture onto a surface of a sheet of paper which is opposite the surface of the sheet which is configured to receive printing thereon.

In an embodiment, the aforesaid method further comprises: selecting the first particle size to be in the range of about 25 to about 200 nanometers, and selecting the second particle size to be in the range of about 1 to about 6 microns. In an embodiment, the first particle size range is about 30-70 nm, and the second particle size range is about 3-5 microns. In another embodiment, the binder is selected from the group consisting of styrene, styrene-acrylic, styrenebutadiene, acrylic, and polyvinyl acetate.

In an embodiment, an aforesaid method further comprises adding a second binder to the mixture wherein the second binder is selected to provide a predetermined characteristic. In an embodiment, the second binder is selected from the group consisting of polyvinyl alcohol, gelatin, starches, cellulose, and modified cellulose. In another embodiment, the predetermined characteristic is curl attenuation.

In an embodiment of an aforesaid method the step of coating comprises forming the coating to have a thickness of thickness in the range of about 3 gsm to about 50 gsm.

A printing paper having a photo feel backcoat is provided in accordance with another embodiment, which comprises first and second surfaces, the first surface being configured to receive printing thereon, the second side having a coating comprising a binder mixed with polymeric particles selected to produce a smooth surface having a photo base texture.

In an embodiment of the aforesaid printing paper, the polymeric particles comprise polyethylene particles. In an embodiment, the polyethylene particles have first and second sizes, the first particle size being in a first range of about 25 to about 200 nanometers and the second particle size being in a second range of about 1 to about 6 microns.

In another embodiment of an aforesaid printing paper, the binder is selected from the group consisting of styrene, styrene-acrylic, styrenebutadiene, acrylic, and polyvinyl acetate. In another embodiment, the binder comprises first and second binders, the first binder being selected from the group consisting of styrene, styrene-acrylic, styrene-butadiene, acrylic, and polyvinyl acetate, and the second binder being selected from the group consisting of polyvinyl alcohol, gelatin, starches, cellulose, and modified cellulose. In an embodiment, the second binder is added to attenuate paper curl.

In an embodiment of an aforesaid printing paper, the coating is applied using a technique selected from one of curtain coating, rod coating or slot coating. In an embodiment, the coating has a thickness in the range of about 3 to about 50 gsm. In another embodiment, the printing paper is a cellulose based paper.

In accordance with another embodiment, an article of manufacture is provided which comprises a sheet of paper having a first and second surface, the second surface having a coating, the coating including: a binder; and polyethylene particles having first and second predetermined sizes, wherein the first predetermined size is substantially smaller than the second predetermined size, and wherein the polyethylene particles having the first and second predetermined sizes are dispersed such that for about every 10 polyethylene particles having the first and second predetermined sizes, there are no more than about 6 polyethylene particles having the first predetermined size and no less than about 4 polyethylene particles having the second predetermined size.

In an embodiment of an aforesaid article of manufacture, the first surface is configured to receive printing thereon. In an embodiment, the coating on the article of manufacture has a smooth surface having a photo base texture. In an embodiment, the coating on the article of manufacture has a thickness in the range of about 3 to about 5 gsm. In an embodiment of an aforesaid article of manufacture, the paper is a cellulose based paper.

EXAMPLE 1

| | |
|---|---|
| 100 parts of binder #1 | Acrylic Latex (Rhoplex GL618) |
| 10 parts of binder #2 | Polyvinyl Alcohol (Mowiol 20-98) |
| 40 parts of particle #1 | Polyethylene particles 4 μm (Michem Guard 20) |
| 60 parts of particle #2 | Polyethylene particles 50 nm (Michem Shield 251) |
| Paper: | coated basestock |
| Coat thickness: | 8 gsm |
| Feel | preferred |

EXAMPLE 2

| | |
|---|---|
| 100 parts of binder #1 | Acrylic Latex (Rhoplex R-253) |
| 40 parts of particle #1 | Polyethylene particles 7 μm (Michem Guard 60) |
| 60 parts of particle #2 | Polyethylene particles 35 nm (Michem Emulsion 39235) |
| Paper: | uncoated basestock |
| Coat thickness: | 20 gsm |
| Feel | acceptable |

EXAMPLE 3

| | |
|---|---|
| 50 parts of binder #1 | Styren/butadiene Latex (Rovene 4021) |
| 40 parts of particle #1 | Teflon particles 4 μm (Michem Glide 5) |
| 60 parts of particle #2 | Polypropylene particles 45 nm (Michem emulsion 43040) |
| Paper: | coated basestock |
| Coat thickness: | 3-5 gsm |
| Feel | acceptable |

It will be appreciated that, although the disclosure has been described with reference to only a limited number of embodiments, the various modifications and changes that can be implemented without departing from the scope of appended claims, will be, given the preceding disclosure, readily apparent to those skilled in the art to which the present disclosure pertains or mostly pertains.

What is claimed is:

1. A method of treating a paper, comprising:

(a) providing a sheet comprising a paper basestock and having a backside and an inkjet ink-receiving side opposite said backside;

(b) applying a coating onto said backside, wherein said coating comprises a binder, an anti-curl agent and a polyethylene particle component consisting of first and second portions of polyethylene particles dispersed in said binder, the particles of said first portion being smaller than the particles of said second portion wherein said first and second portions have non-contiguous particle size ranges, and wherein said applying excludes extrusion coating, to produce a paper with a smooth surface having a photobase texture on said backside.

2. The method of claim 1, wherein, in (b), said first portion of particles are in the range of about 25-200 nanometers, and said second portion of particles are in the range of about 1-6 microns.

3. The method of claim 1, wherein, in (b), said first portion of particles are in the range of about 30-70 nm and said second portion of particles are in the range of about 3-5 microns.

4. The method of claim 1, wherein, in (b), the resulting applied coating comprises a thickness in the range of about 3 to about 50 grams per square meter.

5. The method of claim 1, wherein said binder is selected from the group consisting of styrene, styrene-acrylic, styrene-butadiene, acrylic, and polyvinyl acetate.

6. The method of claim 1, wherein said anti-curl agent is selected from the group consisting of polyvinyl alcohol, gelatin, starches, cellulose, and modified cellulose.

7. The method of claim 1, wherein said basestock comprises an untreated basestock.

8. The method of claim 1, wherein said basestock comprises a treated basestock.

9. The method of claim 8, wherein, in (a), providing said sheet includes:

($a_1$) providing a sheet comprising an untreated basestock and having a backside and an inkjet ink-receiving side opposite said backside; and ($a_2$) treating both said inkjet ink-receiving side and said backside with a print-enhancing offset coating, to yield a treated basestock prior to performing (b).

10. A paper manufactured by the process of claim 1.

11. The paper of claim 10, wherein, in (b), said first portion of particles are in the range of about 25-200 nanometers, and said second portion of particles are in the range of about 1-6 microns.

12. The paper of claim 10, wherein, in (b), said first portion of particles are in the range of about 30-70 nm and said second portion of particles are in the range of about 3-5 microns.

13. The paper of claim 10, wherein said manufactured paper with photobase texture comprises a backcoatinq comprising said binder and said polyethylene particle component wherein, for every 10 parts of said polyethylene particle component, said first portion is no more than 6 parts and said second portion is no less than 4 parts.

14. The paper of claim 10, wherein said manufactured paper with photobase texture comprises a backcoating having a thickness in the range of about 3 to about 50 grams per square meter.

15. The of claim 10, wherein, in (b), said binder is selected from the group consisting of styrene, styrene-acrylic, styrene-butadiene, acrylic, and polyvinyl acetate.

16. The paper of claim 10, wherein said anti-curl agent is selected from the group consisting of polyvinyl alcohol, gelatin, starches, cellulose, and modified cellulose.

17. The paper of claim 10, wherein, in (a), said basestock comprises a treated basestock.

18. The paper of 17, wherein, in (a), providing said sheet includes:

($a_1$) providing a sheet comprising an untreated basestock and having a backside and an ink-receiving side opposite said backside; and ($a_2$) treating both said ink-receiving side and said backside with a print-enhancing offset coating, to yield a treated basestock prior to performing (b).

* * * * *